US010167622B2

(12) United States Patent
Brooks et al.

(10) Patent No.: US 10,167,622 B2
(45) Date of Patent: Jan. 1, 2019

(54) DRAIN ASSEMBLY WITH ADJUSTABLE SPHERICAL FRAME

(71) Applicant: Zurn Industries, LLC, Milwaukee, WI (US)

(72) Inventors: Seth A. Brooks, Syracuse, NY (US); Jason E. Morris, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 86 days.

(21) Appl. No.: 15/340,676

(22) Filed: Nov. 1, 2016

(65) Prior Publication Data

US 2017/0130442 A1 May 11, 2017

Related U.S. Application Data

(60) Provisional application No. 62/253,993, filed on Nov. 11, 2015.

(51) Int. Cl.

| | |
|---|---|
| ***E03F 5/04*** | (2006.01) |
| ***E04F 15/12*** | (2006.01) |
| ***E03F 5/06*** | (2006.01) |

(52) U.S. Cl.

CPC ..... *E03F 5/0407* (2013.01); *E03F 5/0411* (2013.01); *E03F 5/06* (2013.01); *E04F 15/12* (2013.01); *E03F 2005/0413* (2013.01); *E03F 2005/0414* (2013.01)

(58) Field of Classification Search

CPC ..... E03F 5/0407; E03F 5/0411; E03F 5/06; E03F 2005/0413; E03F 2005/0414; E04F 15/12

USPC ..... 210/163, 164; 4/286, 288, 679, 695; 52/302.1, 302.7

See application file for complete search history.

(56) References Cited

U.S. PATENT DOCUMENTS

| | | | | |
|---|---|---|---|---|
| 1,779,936 | A * | 10/1930 | Hess | E04D 13/0409 210/163 |
| 2,190,532 | A | 2/1940 | Lukomski | |
| 5,921,282 | A | 7/1999 | Castillo et al. | |
| 6,076,559 | A | 6/2000 | Castillo et al. | |
| 6,269,495 | B1 | 8/2001 | Sondrup | |
| 6,350,373 | B1 | 2/2002 | Sondrup | |
| 6,381,775 | B1 | 5/2002 | Sondrup | |
| 6,955,499 | B2 | 10/2005 | Sondrup | |
| 7,735,512 | B1 | 6/2010 | Ismert et al. | |

(Continued)

FOREIGN PATENT DOCUMENTS

| | | |
|---|---|---|
| CH | 614004 | * 10/1979 |
| EP | 1 811 093 A1 | 7/2007 |

*Primary Examiner* — Christopher Upton
(74) *Attorney, Agent, or Firm* — Quarles & Brady LLP

(57) ABSTRACT

A floor drain assembly including a collar, a shank coupled to the collar, a frame, an insert coupled to the shank and capturing the frame between the insert and the shank, a strainer coupled to the frame, a protective cover coupled to the strainer, and a sleeve surrounding the collar, the shank, the frame, the insert, the strainer, and the protective cover. The shank is moveable relative to the collar and includes a spherically shaped shank surface. The frame includes a lower frame surface shaped to engage the shank surface and an upper frame surface. The insert is moveable relative to the shank and includes a spherically shape insert surface engaged with the upper frame surface such that the frame is captured between the insert and the shank.

24 Claims, 21 Drawing Sheets

(56) References Cited

U.S. PATENT DOCUMENTS

| | | | | |
|---|---|---|---|---|
| 8,096,002 | B2 * | 1/2012 | Stimpson | E03F 5/0408 210/163 |
| 8,347,906 | B1 | 1/2013 | Ismert et al. | |
| 8,566,976 | B2 | 10/2013 | Evans et al. | |
| 2008/0290012 | A1 * | 11/2008 | Shih | E03F 5/0407 210/163 |
| 2009/0223884 | A1 * | 9/2009 | Wroblewski | E03F 5/0407 210/163 |
| 2010/0126917 | A1 * | 5/2010 | Wroblewski | E03F 5/0407 52/302.1 |
| 2013/0193042 | A1 | 8/2013 | Hull | |
| 2014/0020174 | A1 | 1/2014 | Evans et al. | |
| 2014/0138297 | A1 | 5/2014 | Hull | |

* cited by examiner

DRAIN ASSEMBLY WITH ADJUSTABLE SPHERICAL FRAME

CROSS-REFERENCE TO RELATED APPLICATION

This application is based on and claims priority to U.S. Provisional Patent Application No. 62/253,993, filed Nov. 11, 2015, the contents of which are incorporated herein by reference in its entirety for all purposes.

STATEMENT OF FEDERALLY SPONSORED RESEARCH OR DEVELOPMENT

Not applicable.

TECHNICAL FIELD

This disclosure relates to floor drains. Specifically, this disclosure relates to floor drains intended to be installed in a poured concrete floor.

BACKGROUND

Floor drains are installed in buildings to provide drainage of liquids that are deposited on a floor. Typical floor drains provide a rigid housing that must be accurately set when pouring a concrete floor to ensure that the drain is aligned with the finish grade of the floor. Additionally, inconsistencies in the concrete pour or out of level flooring situations must be accounted for or adjusted when the finished floor surface is installed.

SUMMARY

A need exists for a floor drain that is height adjustable after a rough pour of concrete and includes a tilting capability. Additionally, a floor drain installation system that provides a clean floor drain after installation is desirable.

This disclosure provides for a floor drain assembly including a collar, a shank coupled to the collar, a frame, an insert coupled to the shank, a strainer coupled to the frame, a protective cover coupled to the strainer, and a sleeve surrounding the collar, shank, frame, insert, strainer, and protective cover. The shank is movable relative to the collar, and includes a spherically shaped shank surface. The frame includes a lower frame surface shaped to engage the shank surface and an upper frame surface. The insert is movable relative to the shank, and includes a spherically shaped insert engaged with the upper frame surface such that the frame is captured between the insert and the shank.

In some forms, the collar may include internal threads and the shank may include external threads, which can be configured to engage one another. In some forms, the shank can move relative to the collar along a central axis.

In some forms, the shank may have internal threads and the insert may have external threads, which may be configured to engage one another. In some forms, the insert can move relative to the shank along a central axis. In some forms, the insert and the shank may be moved apart from one another to allow the frame to be tilted and rotated relative to a central axis. In some embodiments, the insert and shank can be moved together to inhibit the frame from moving. In some forms, the spherically shaped shank surface and the spherically shaped insert surface allow the frame to be tilted in any direction by about three degrees relative to a central axis.

In some forms, the sleeve can include a cylindrical portion sized to engage the collar. The sleeve may include a lip sized to engage the shank. The sleeve may include a head area sized to surround the frame and strainer. The sleeve may include a removable retaining ring in some embodiments. Additionally, the retaining ring may include a central aperture and may engage a head area of the sleeve with tabs. The retaining ring may also be rotatably removable from the sleeve. In some forms, the sleeve may include a pull strip. In some forms, the pull strip is removable from the sleeve by a grasping and pulling action.

In some forms, the sleeve includes a base coupled to the collar. The sleeve may additionally include a cover that is slidably coupled to the base and is configured for different height installations. In some forms, the protective cover may be coupled to the sleeve with a pull strip, which may also be removable and, when removed, detaches the protective cover from the sleeve. In some embodiments, the protective cover is an adhesive backed sticker. In some forms, the shank and the insert may provide height and tilt adjustment of the frame and strainer before and during installation.

A method for installing a floor drain of the type described above is also disclosed. The method comprises coupling the collar with a drain body, coupling the drain body with a drain pipe, making a rough pour of concrete around a portion of the drain assembly, adjusting a height of the strainer, making a finish pour, removing a portion of a retaining ring coupled to the sleeve, and removing the protective cover from the strainer.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
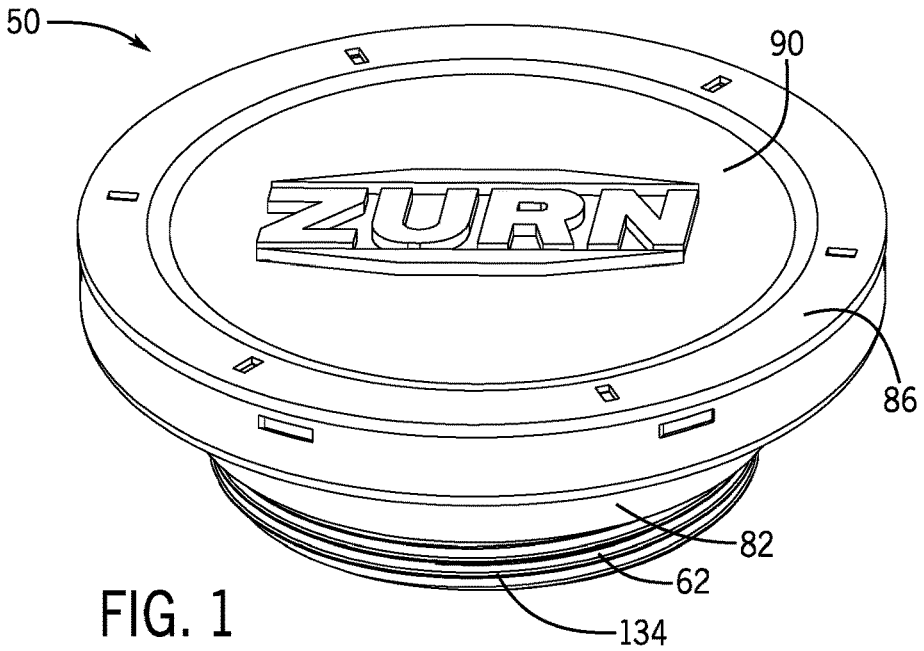
FIG. 1 is a perspective view of a floor drain head.

Before any embodiments of the invention are explained in detail, it is to be understood that the embodiments described are not limited in application to the details of construction and the arrangement of components set forth in the following description or illustrated in the following drawings. The described apparatus is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the apparatus described herein. Various modifications to the illustrated embodiments will be readily apparent to those skilled in the art, and the generic principles herein can be applied to other embodiments and applications without departing from the embodiments described herein below. Thus, embodiments of the described apparatus are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the described embodiments. Skilled artisans will recognize the examples provided herein have many useful alternatives and fall within the scope of the described embodiments.

Figure 2:
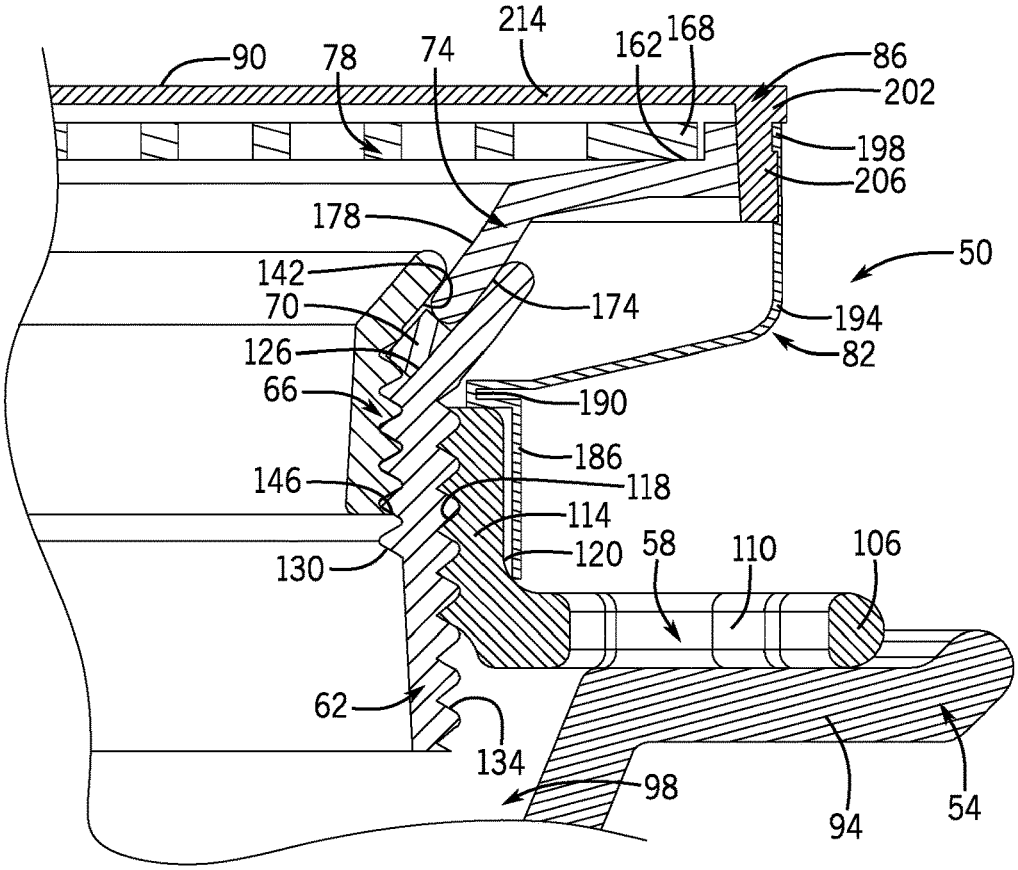
FIG. 2 is a partial cross-sectional view of a floor drain system including the floor drain head of FIG. 1.

Referring now to the drawings in which like reference numerals designate like or corresponding parts throughout the several views, FIGS. 1 and 2 show a floor drain assembly 50 that includes a drain body 54, a threaded collar 58, a shank 62, an insert 66, a spacer 70, a frame 74, a strainer 78, a sleeve 82, a retaining ring 86, and a protective cover 90. Specifically, FIG. 1 shows a floor drain head and FIG. 2 shows the entire floor drain system or assembly.

Figure 15:
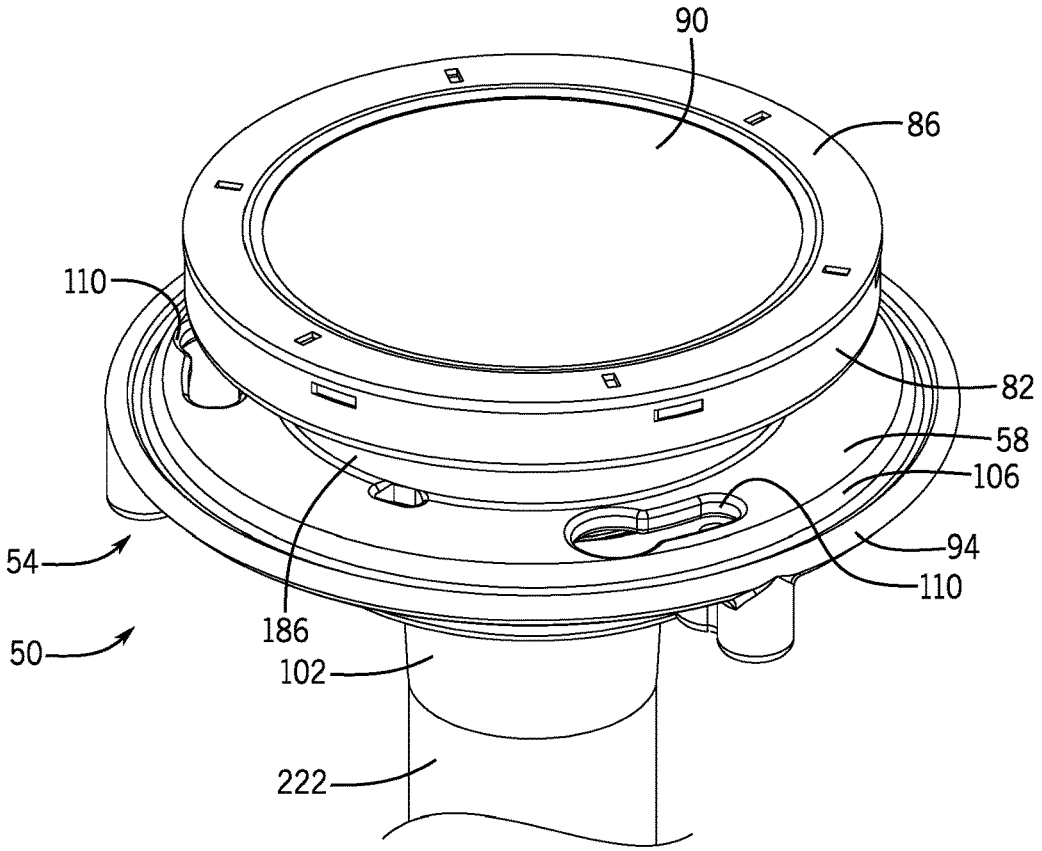
FIG. 15 is a perspective view of a first installation step of the floor drain system of FIG. 2.

The drain body 54 includes a body flange 94 and a drainage cavity 98. As shown in FIG. 15, for example, the drain body 54 also includes a drain tube coupling 102 for connection to rough plumbing 222.

The threaded collar 58 includes a collar flange 106 with apertures in the form of screw slots 110, and an upright portion 114 with a threaded internal bore 118 and a cylindrical outer surface 120. In the illustrated construction, the collar flange 106 includes three screw slots 110.

Figure 3:
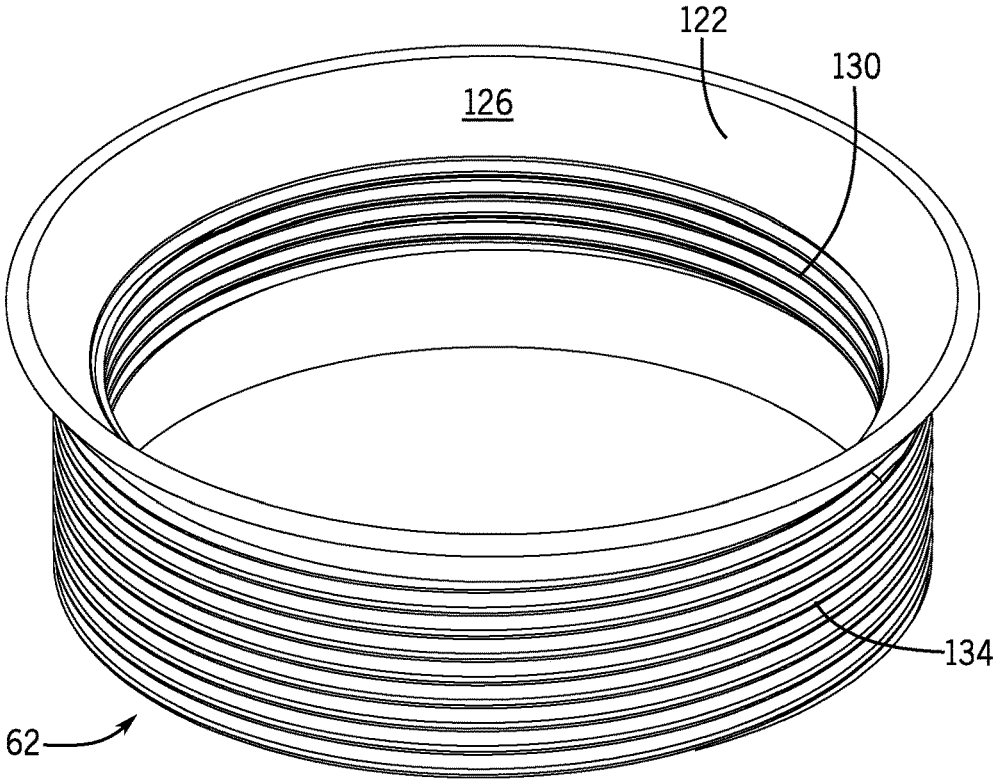
FIG. 3 is a perspective view of a shank of the floor drain system of FIG. 2.
Figure 4:
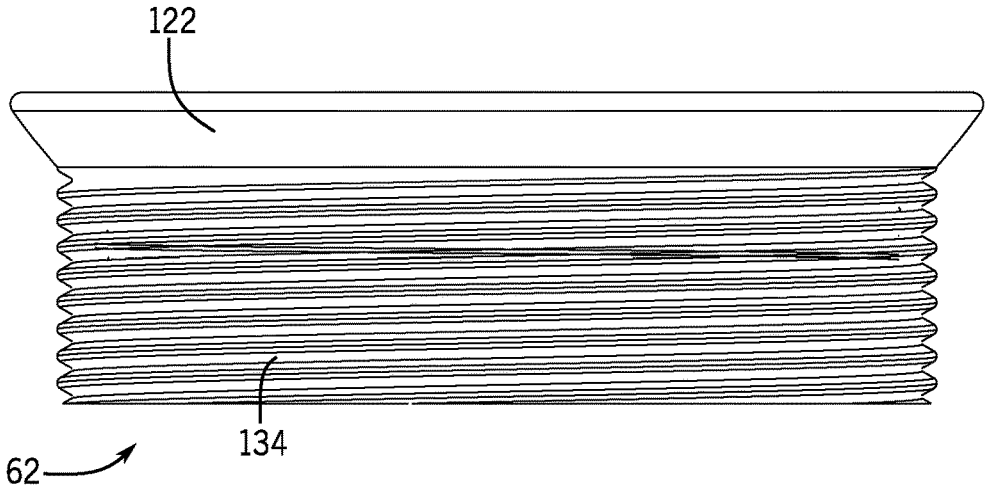
FIG. 4 is a side elevational view of the shank of FIG. 3.

As shown in FIGS. 3 and 4, the shank 62 includes a spherically shaped shank upper portion 122 that defines a shank surface 126, an inner threaded portion 130, and an outer threaded portion 134. As used herein the term "spherically shaped" is contemplated as covering frusto-spherical shapes (i.e., spherical shapes that are partially truncated). In the illustrated construction, the shank surface 126 is concave and defines a spherical radius of curvature. The outer threaded portion 134 is sized to threadingly engage the threaded internal bore 118 of the threaded collar 58.

Figure 5:
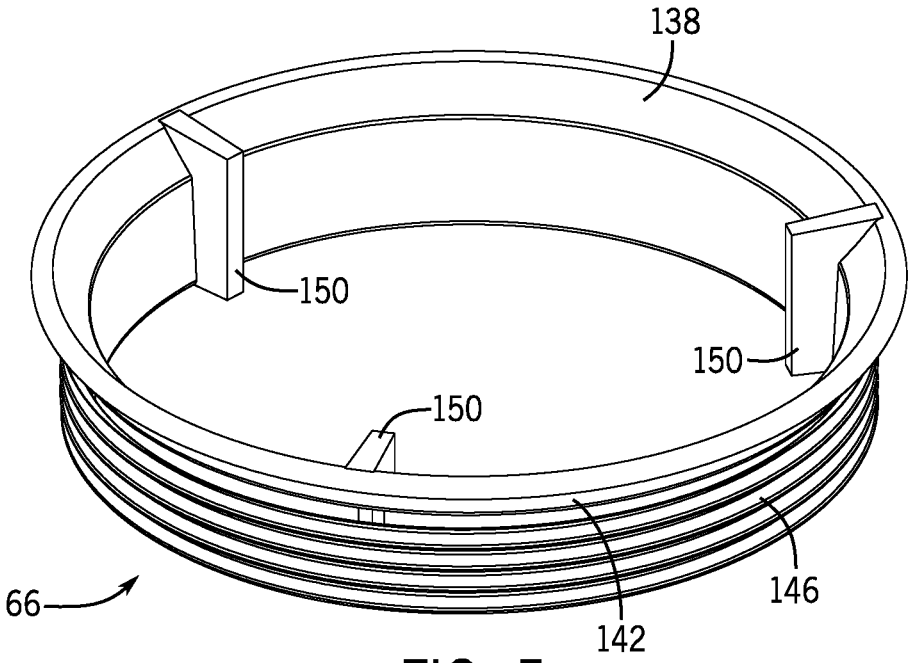
FIG. 5 is a perspective view of an insert of the floor drain system of FIG. 2.
Figure 6:
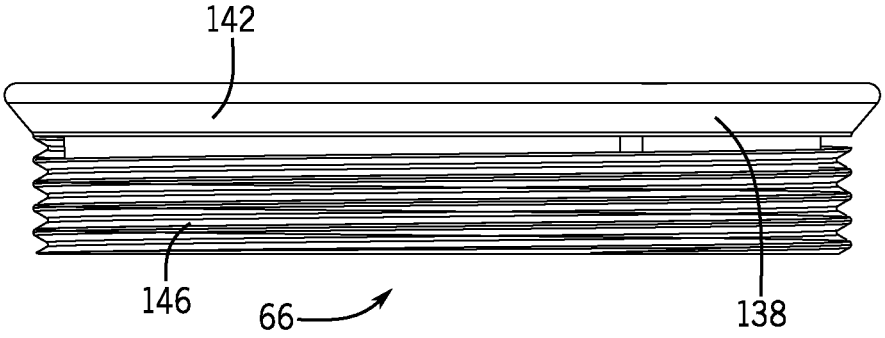
FIG. 6 is a side elevational view of the insert of FIG. 5.

As shown in FIGS. 5 and 6, the insert 66 includes a spherically shaped insert upper portion 138 that defines an insert surface 142, an outer threaded portion 146, and three support ribs 150. In the illustrated construction, the insert surface 142 is convex and has the same or near similar radius of curvature as a frame surface 178. The outer threaded portion 146 is sized to threadingly engage the inner threaded portion 130 of the shank 62. In other constructions, more than three or less than three support ribs 150 may be included. Alternatively, the support ribs 150 may be eliminated.

Figure 7:
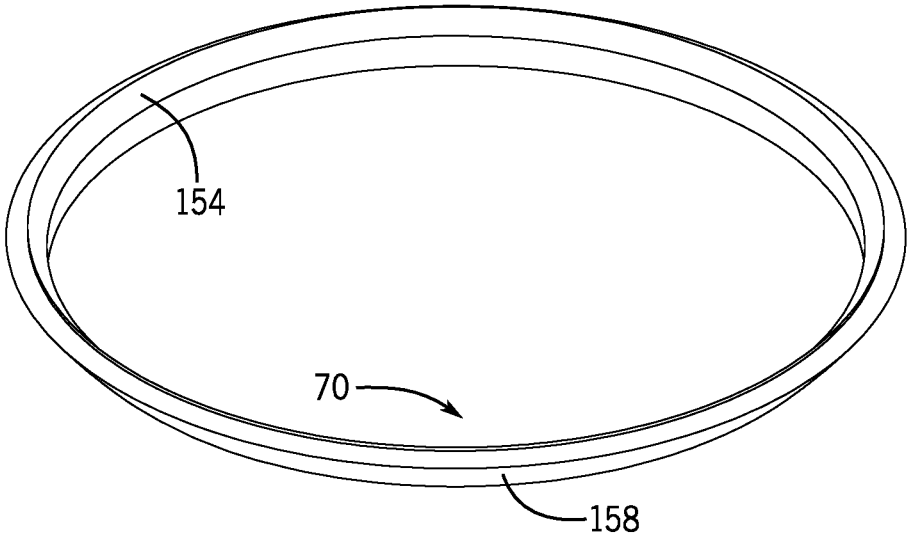
FIG. 7 is a perspective view of a spacer of the floor drain system of FIG. 2.

As shown in FIG. 7, the spacer 70 is ring shaped and defines an inner spherically shaped surface 154 and an outer spherically shaped surface 158. The inner and outer surfaces 154, 158 are shaped to mate with the insert surface 142 and the shank surface 126, respectively.

Figure 8:
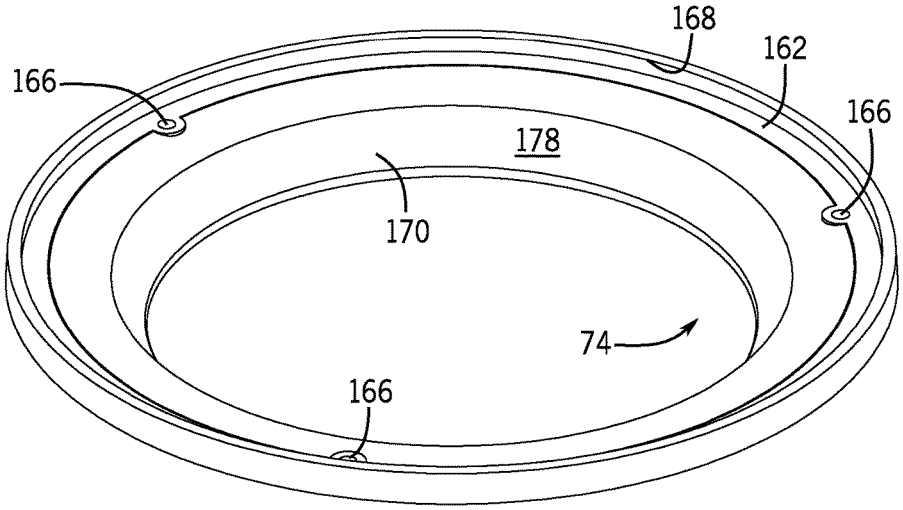
FIG. 8 is a perspective view of a frame of the floor drain system of FIG. 2.
Figure 9:
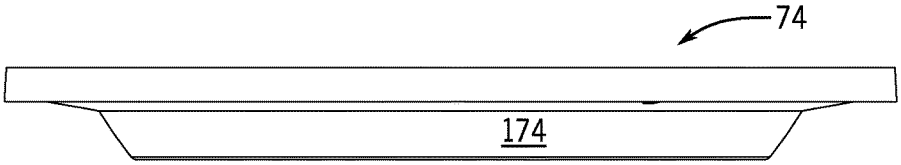
FIG. 9 is a side elevational view of the frame of FIG. 8.

As shown in FIGS. 8 and 9, the frame 74 includes a frame flange 162 that includes three threaded apertures 166 and a lip 168, and a lower spherical portion 170 that includes a lower spherically shaped surface 174, and an upper spherically shaped surface 178. The illustrated frame flange 162 has a circular shape, although in alternative constructions the frame flange 162 may be any drain shape desirable. The lower and upper surfaces 174, 178 are shaped to engage the shank surface 126 and the insert surface 142, respectively. In other words, the lower surface 174 is convex shaped with the same radius of curvature as the shank surface 126, and the upper surface 178 is concave with the same radius of curvature as the insert surface 142.

Figure 10:
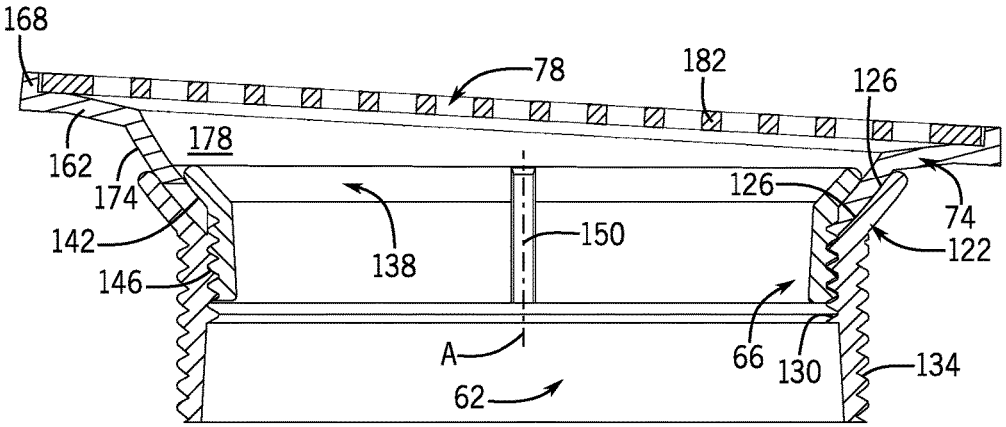
FIG. 10 is a cross-sectional view of the frame, shank, and insert and a strainer of the floor drain system of FIG. 2.

As shown in FIG. 10, the strainer 78 is sized to be received within the lip 168 and defines a pattern of apertures 182 intended to allow liquid egress and inhibit solid particles from entering the drain. The strainer 78 may be attached to the frame flange 162 by engaging fasteners with the threaded apertures 166 formed in the frame flange 162, by snap-on style features, or other acceptable coupling methods.

Assembly of the shank 62, the insert 66, the frame 74, and the strainer 78 will be discussed below with respect to FIG. 10. The frame 74 is set into the shank 62 such that the lower surface 174 of the frame 74 engages the shank surface 126. The insert 66 is then inserted into the shank 62 and the outer threaded portion 146 of the insert 66 is engaged with the inner threaded portion 130 of the shank 62. The insert 66 is then threaded into the shank 62 to sandwich the frame 74 between the insert 66 and the shank 62. The frame 74 is then adjusted to the desired position, and the insert 66 is tightened to lock the frame 74 in place. Once the frame 74 is secured, the strainer 78 is then coupled to the frame 74.

The spherically shaped surfaces 126, 174, 178, 142 allow the frame 74 to be manipulated rotationally around a central axis A, and can be tilted about 3 degrees in all directions relative to the central axis A. The rotational capability allows an installer to position the frame 74 to align with a tile floor or room dimensions, for example.

In an alternative installation, the spacer 70 is seated against the shank surface 126 before the frame 74 and the insert 66 are inserted. As shown in FIG. 2, the spacer 70 inhibits the frame 74 from tilting while still allowing for rotational adjustment.

Figure 11:
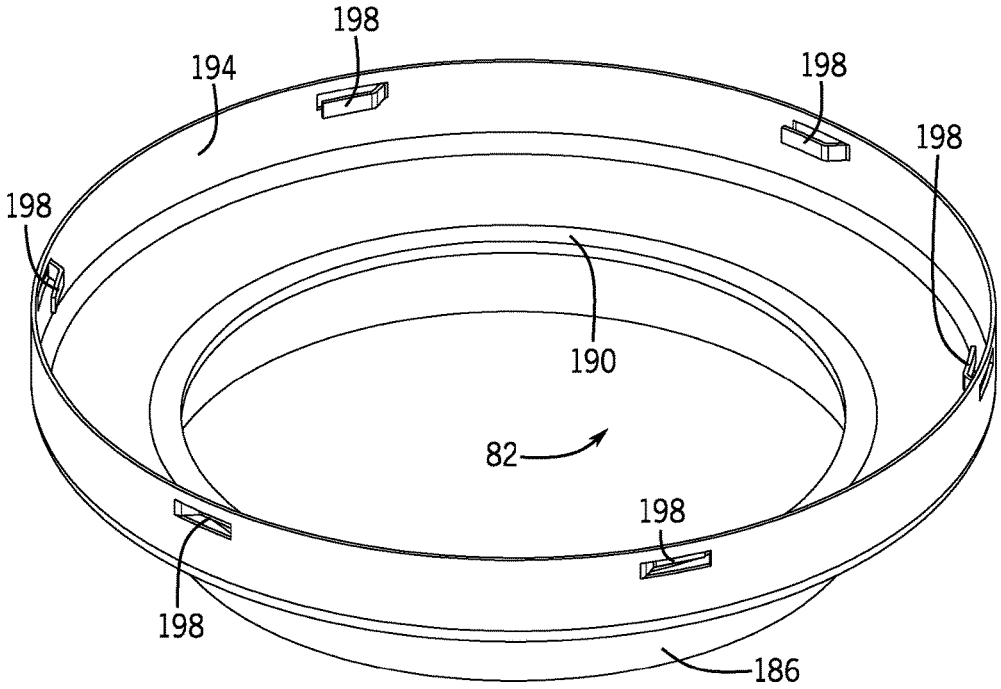
FIG. 11 is a perspective view of a sleeve of the floor drain system of FIG. 2.
Figure 12:
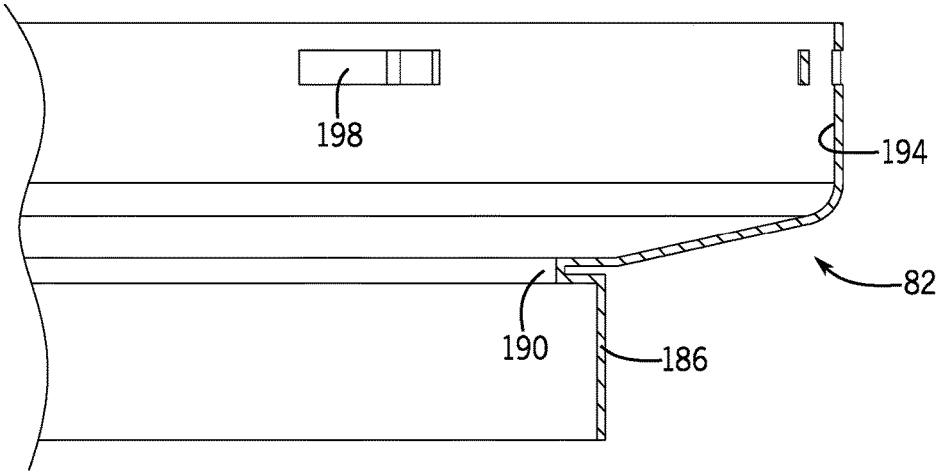
FIG. 12 is a cross-sectional view of the sleeve of FIG. 11.

As shown in FIGS. 11 and 12, the sleeve 82 includes a lower cylindrical portion 186 sized to receive the cylindrical outer surface 120 of the threaded collar 58, a lip 190 sized to engage the shank 62, and a head area 194 shaped to correspond to and sized to surround the frame 74. A plurality of tabs 198 are positioned around the perimeter of the head area 194 and extend inward. The sleeve 82 may be a metal, a polymer, or other materials suitable for use in drain applications.

Figure 13:
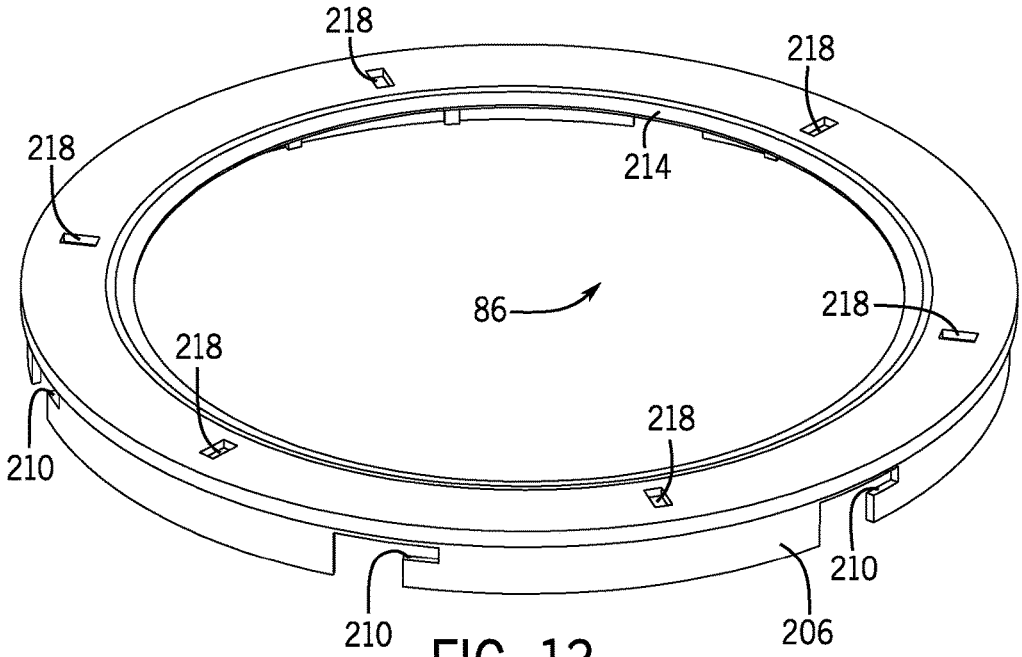
FIG. 13 is a top perspective view of a retaining ring of the floor drain system of FIG. 2.
Figure 14:
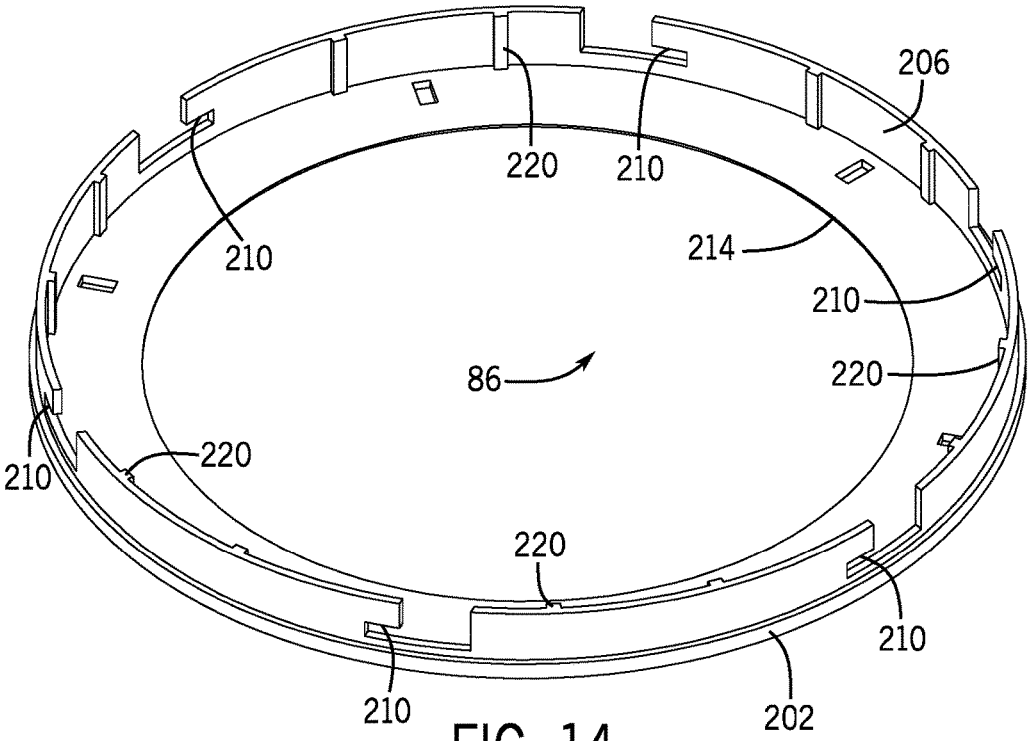
FIG. 14 is a bottom perspective view of the retaining ring of FIG. 13.

As shown in FIGS. 13 and 14, the retaining ring 86 includes a lip 202 and a flange in the form of a substantially vertical downward extending wall 206. The wall 206 is sized to be received within the head area 194 and includes recesses 210 positioned and sized to receive the tabs 198 of the sleeve 82. The retaining ring 86 also includes a central aperture 214, notches 218, and alignment ribs 220 sized to engage the frame 74 and help center the retaining ring 86. The retaining ring 86 is shaped to match the head area of the sleeve 82. The lip 202 extends past the wall 206 and is sized to extend over and cover the head area 194 of the sleeve 82 as shown in FIG. 2. The retaining ring 86 can be made of a rigid polymer or other materials capable of preventing concrete from contacting the frame 74 or strainer 78.

As shown in FIGS. 1 and 2, the protective cover 90 can be an adhesive sticker that may be printed with a logo or text. The protective cover 90 may be coated with a transparent, resilient polymer and can be sized to cover a substantial portion of both the strainer 78 and the frame 74. Optionally, the cover can be sized to cover the entire strainer 78 and frame 74. In some embodiments, the adhesive is easily removed and will not leave a residue on the frame 74 or the strainer 78.

Assembly of the floor drain assembly 50 will be described below with reference to FIG. 2. The shank 62, frame 74, insert 66, and strainer 78 are assembled as described above. The protective cover 90 is then adhered to the strainer 78 and the frame 74. Then, the sleeve 82 is slid over the assembled shank 62, frame 74, insert 66, and strainer 78 from the bottom until the lip 190 engages the shank 62. The retaining ring 86 is then inserted into the head area 194 and rotated such that the tabs 198 engage the recesses 210. The threaded collar 58 is then threaded onto the external threaded portion 134 of the shank 62. Finally, the drain body 54 is fastened to the threaded collar 58.

Figure 16:
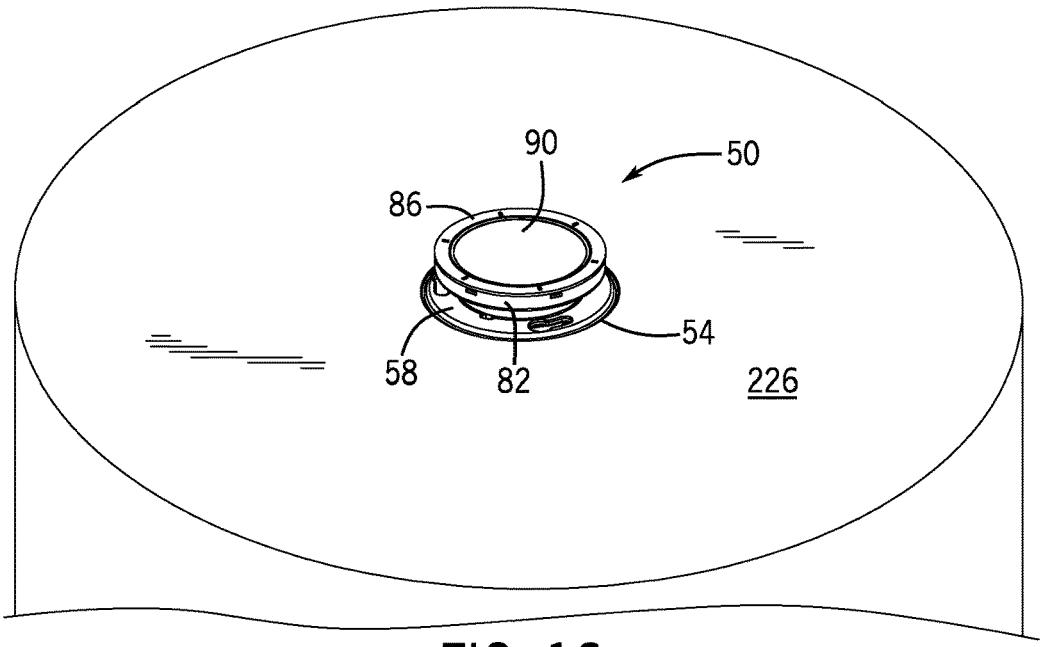
FIG. 16 is a perspective view of a second installation step of the floor drain system of FIG. 2.

Installation of the floor drain assembly 50 into a floor will be described below with reference to FIGS. 15-24. As shown in FIG. 15, the assembled floor drain assembly 50 is first coupled to a drain pipe 222. A rough pour of concrete 226 is then completed, as shown in FIG. 16. The rough pour 226 is level with a top of the body flange 94 of the drain body 54. The cylindrical portion 186 of the sleeve 82 inhibits the rough pour 226 from contacting the outer threaded portion 134 of the shank 62 (shown in FIG. 2). With the rough pour 226 completed, a waterproof membrane may be laid down over the rough pour 226 and clamped between the collar flange 106 of the threaded collar 58 and the body flange 94 of the drain body 54 (not shown).

Figure 17:
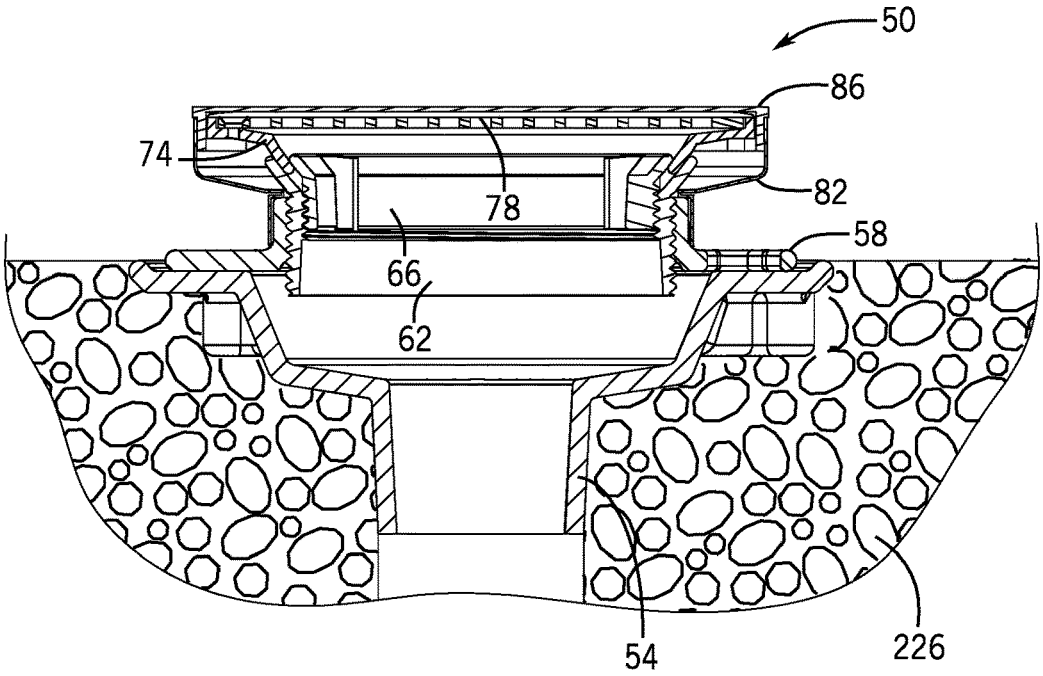
FIG. 17 is a cross-sectional side view of a third installation step of the floor drain system of FIG. 2 showing a minimum height configuration.
Figure 18:
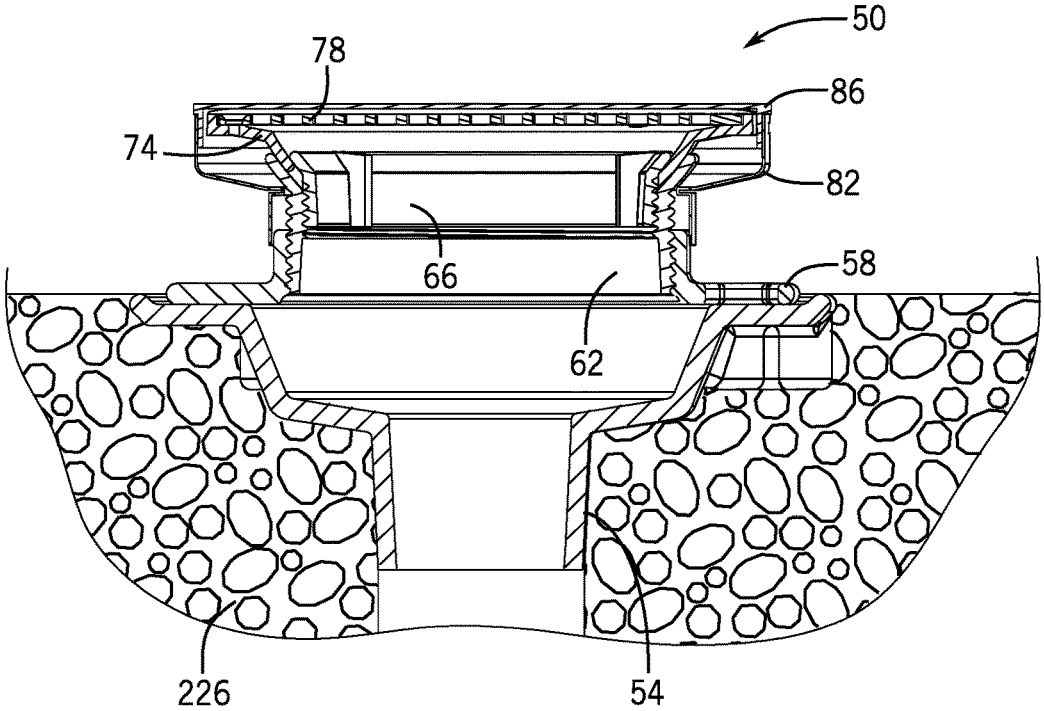
FIG. 18 is another cross-sectional view of the third installation step of the floor drain system of FIG. 2 showing a maximum height configuration.
Figure 19:
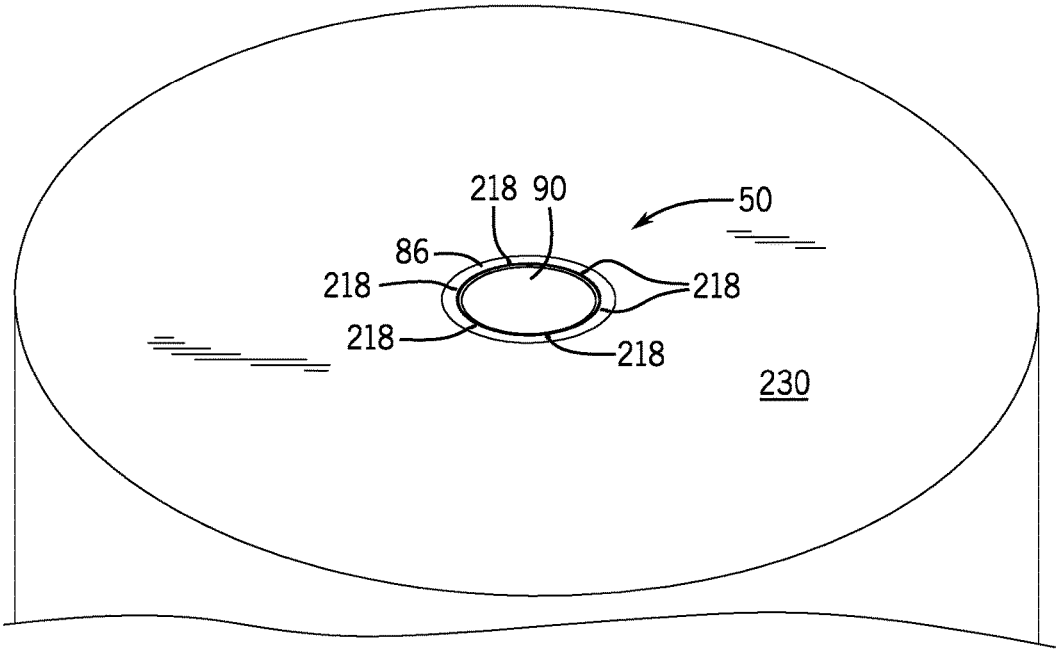
FIG. 19 is a perspective view of a fourth installation step of the floor drain system of FIG. 2.

With the rough pour 226 completed, the height of the strainer 78 can be adjusted to match the desired thickness of a finish pour 230 (see FIG. 19). As shown in FIGS. 17 and 18, the shank 62 may be threaded into and out of the threaded collar 58 to adjust the height of the strainer 78. In the illustrated construction, the height of the strainer 78 can be adjusted between about 1.70 inches and 2.13 inches above the rough pour 226. In other constructions, larger or smaller adjustment is possible.

As shown in FIG. 19, the finish pour 230 is then poured to the top of the retaining ring 86. The cylindrical portion 186 of the sleeve 82 inhibits the finish pour 230 from contacting the outer threaded portion 134 of the shank 62. The finish pour 230 is then screeded. Even when using tile, the installer can screed the finish pour 230 with the retaining ring 86 level with the finish pour 230. This provides an easier and better quality finish.

Figure 20:
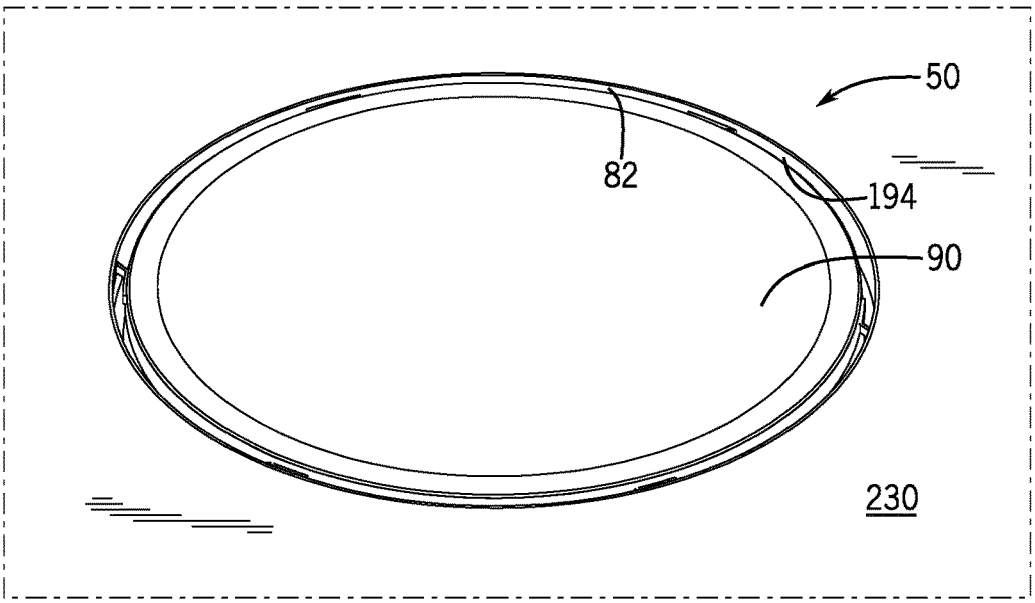
FIG. 20 is a perspective view of a fifth installation step of the floor drain system of FIG. 2.
Figure 21:
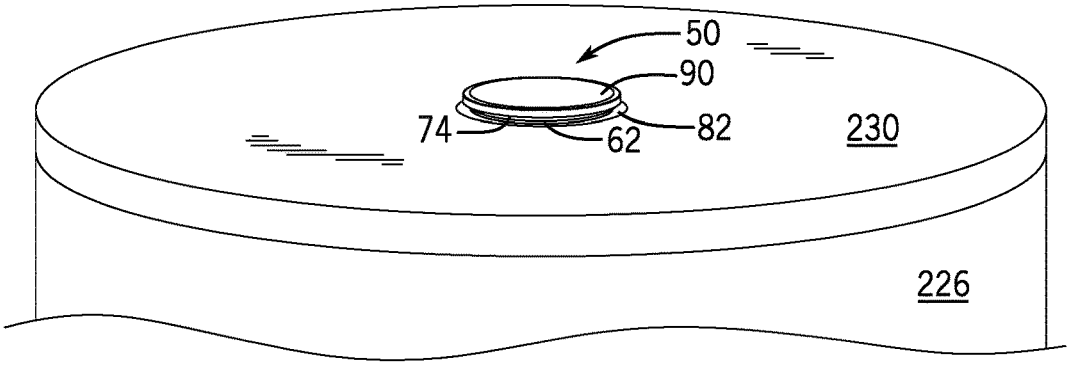
FIG. 21 is a perspective view of a sixth installation step of the floor drain system of FIG. 2.

Once the finish pour 230 is set, the installer may engage the notches 218 on the retaining ring 86 with a screw driver or other tool tangentially, and lightly taps to rotate the retaining ring 86 such that the tabs 198 disengage the recesses 210. The retaining ring 86 can then be removed, as shown in FIG. 20, to reveal the strainer 78 and frame 74 covered by the protective cover 90 set within head area 194. In other constructions, the retaining ring 86 may be removed differently. For example, the retaining ring 86 may be held in place by an interference fit with the sleeve 82, or another mechanism may be used to temporarily hold the retaining ring 86 in place.

As shown in FIG. 21, the shank 62 may again be threaded out of the threaded collar 58 to raise the strainer 78 and cover 90 to the desired height above the finish pour 230 and tilted to match the finish grade.

Figure 22:
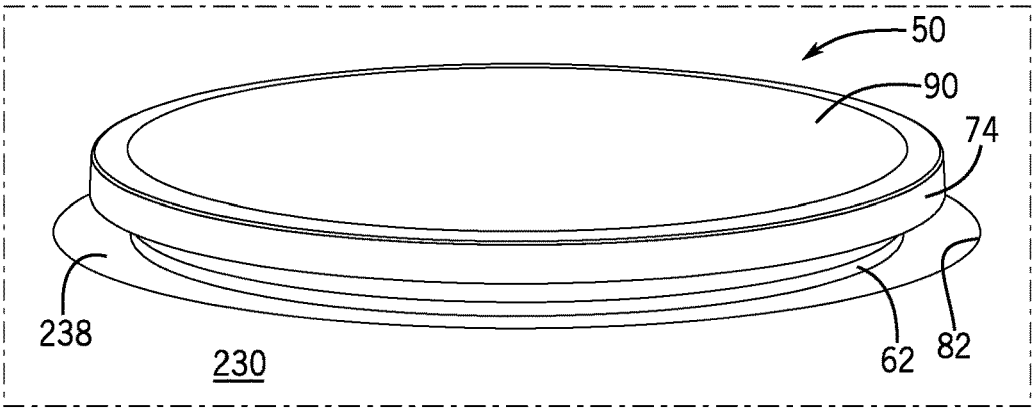
FIG. 22 is a perspective view of a seventh installation step of the floor drain system of FIG. 2.

Once the strainer 78 is at the desired height, the head area 194 can be backfilled with grout 238, as shown in FIG. 22. The grout 238 both secures the shank 62 in position and allows any load applied to the frame to be transferred to the concrete rather than the shank 62.

Figure 23:
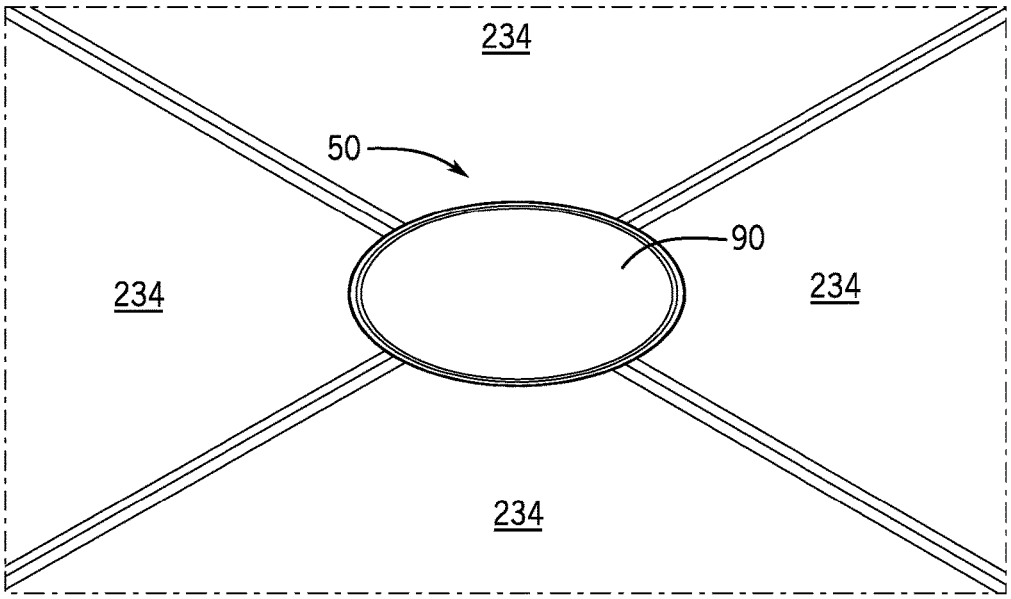
FIG. 23 is a perspective view of an eighth installation step of the floor drain system of FIG. 2.
Figure 24:
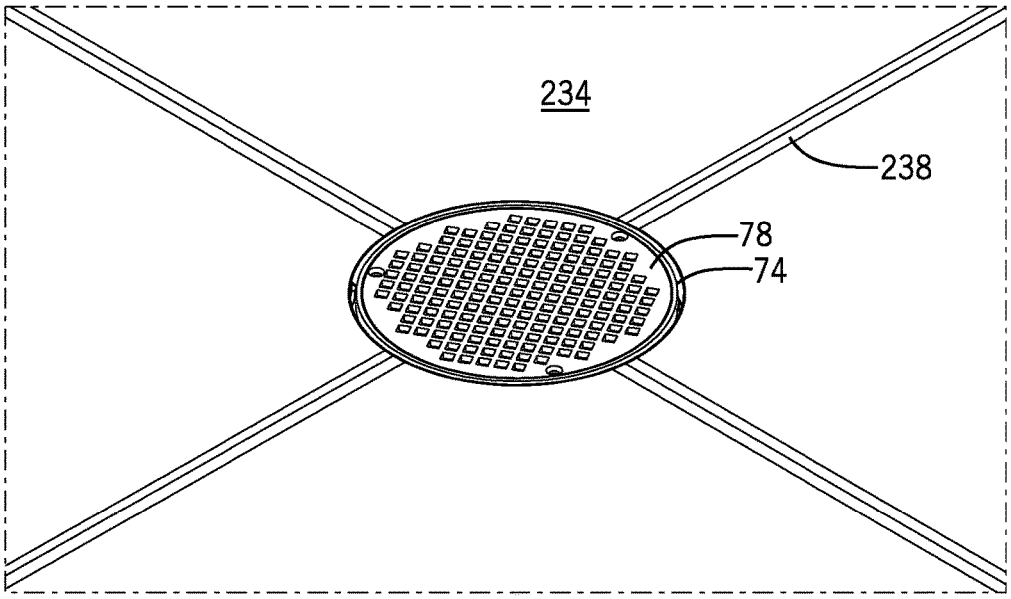
FIG. 24 is a perspective view of a ninth installation step of the floor drain system of FIG. 2.

As shown in FIG. 23, the tile 234 can then be laid around the floor drain assembly 50 and grouted. In FIG. 24, the protective cover 90 can be removed, leaving a damage-free strainer 78 and frame 74 that the end user will enjoy. The protective cover 90 can be left in place from the beginning of the installation until the installation is complete and can prevent debris or chemicals from the installation from entering the drain.

An alternative sleeve 242 is shown and described below with reference to FIGS. 25-43. The sleeve 242 can be used with the same drain body 54, threaded collar 58, shank 62, insert 66, spacer 70, frame 74, strainer 78, and retaining ring 86, described above.

Figure 25:
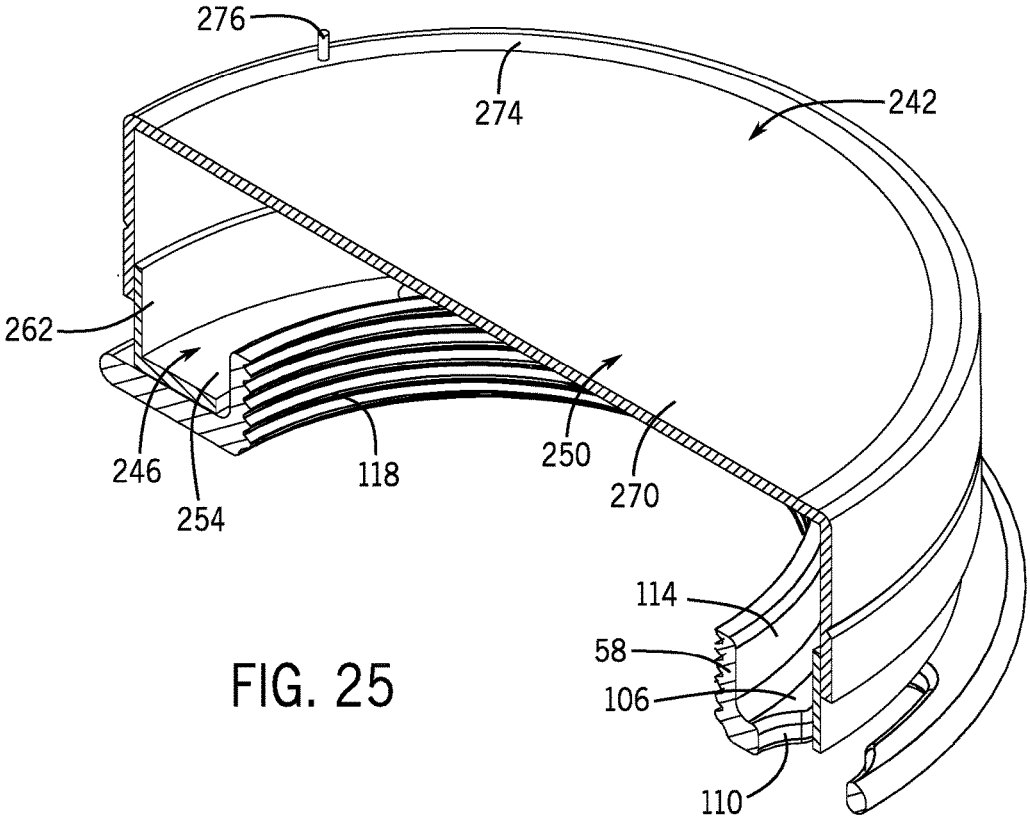
FIG. 25 is a perspective cross-sectional view of an alternative sleeve assembly.
Figure 26:
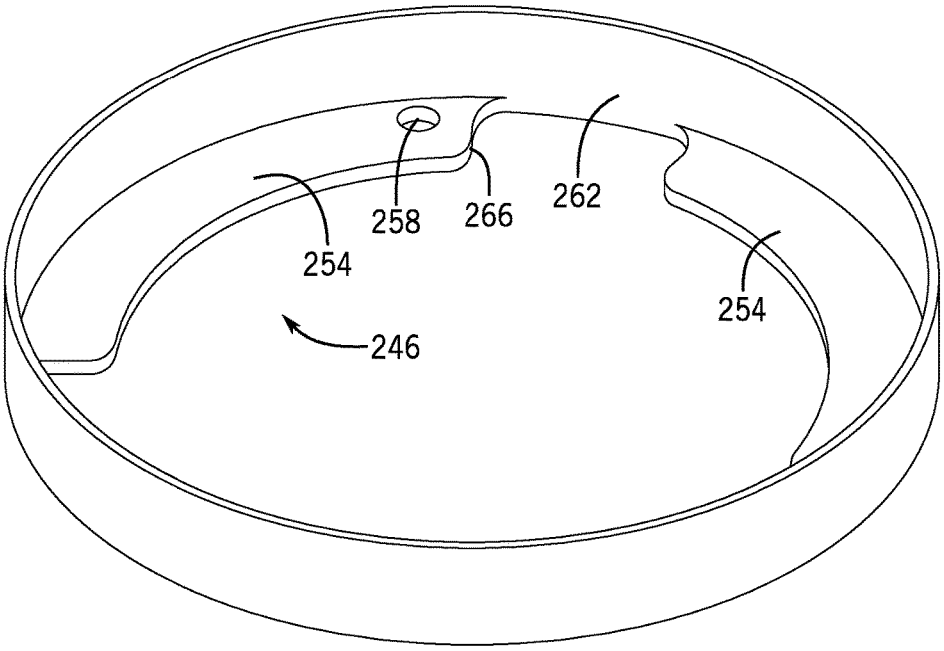
FIG. 26 is a perspective view of a base of the sleeve assembly of FIG. 25.

As shown in FIG. 25, the sleeve 242 includes a base 246 and a cover 250. As shown in FIG. 26, the base includes a base flange 254 with apertures 258, and an upright wall 262. The illustrated base 246 includes three apertures 258, although more or less apertures may be included, or the apertures 258 may be eliminated. The flange 254 also includes gaps 266 arranged to align with the screw slots 110 of the threaded collar 58. The illustrated upright wall 262 defines a height of about 0.9 inches.

Figure 27:
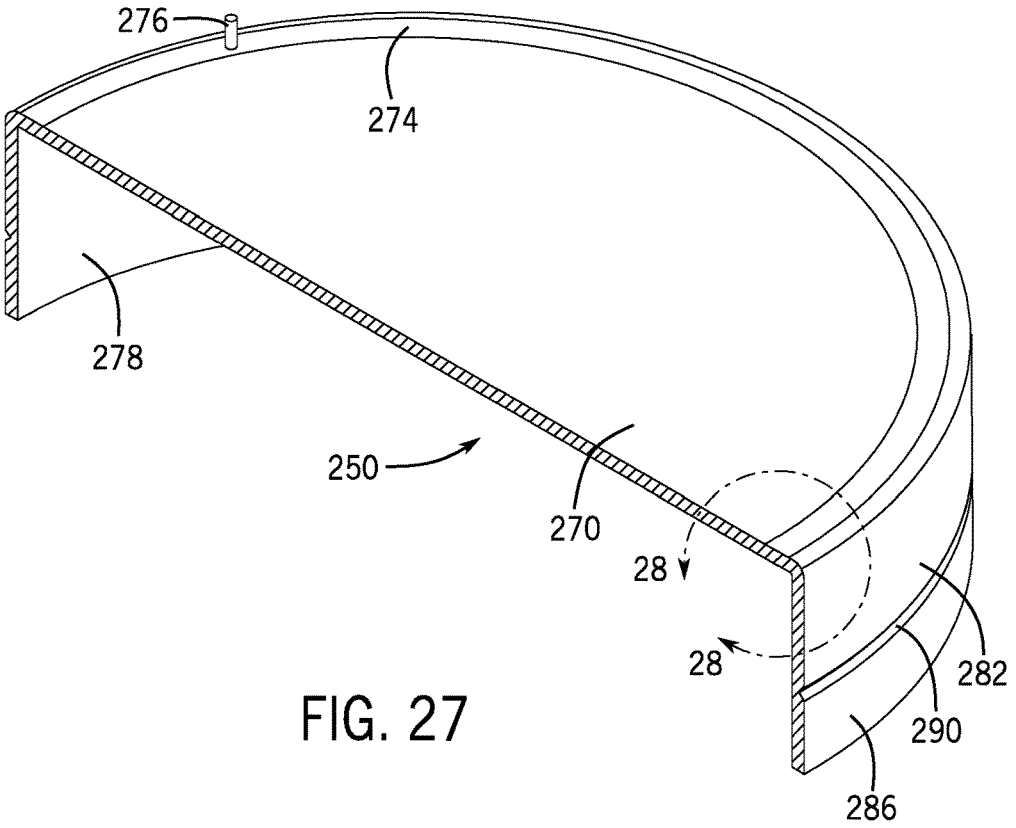
FIG. 27 is a perspective cross-sectional view of a sleeve of the sleeve assembly of FIG. 25.
Figure 28:
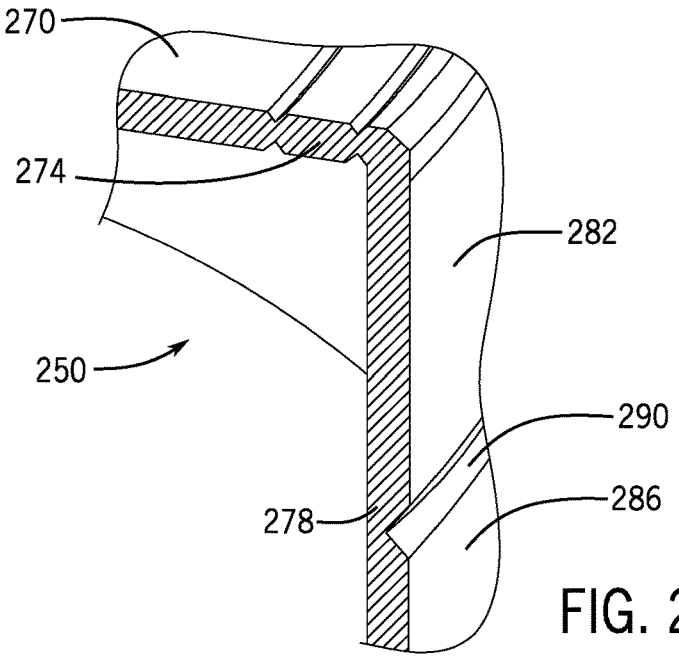
FIG. 28 is a detail view of the sleeve of FIG. 27 taken within the line 28-28 of FIG. 27.

As shown in FIG. 27, the cover 250 includes a top disk 270, a pull strip 274, a pull tab 276 connected to the pull strip 274, and a vertical wall 278 split into an upper portion 282 and a lower portion 286. The height of the illustrated vertical wall 278 is about 1.6 inches and a parting line 290 between the upper and lower portion 282, 286 is positioned about one inch from the top disk 270. The illustrated pull strip 274 is about 0.2 inches wide and separated from the top disk 270 by grooves. The pull tab 276 is created by part of the pull strip 274 and is fully cutout and knurled to allow for easy gripping by pliers or other gripping tools. The bottom of the top disc 270 may include features configured to attach to the frame 74 or strainer 78, such as adhesives, for example. In some embodiments, top cover 270 can share one or many of the characteristics of protective cover 90, discussed in detail above.

Installation of a floor drain assembly 50' including the sleeve 242 is similar to the installation above and is described below with reference to FIGS. 29-38.

Figure 29:
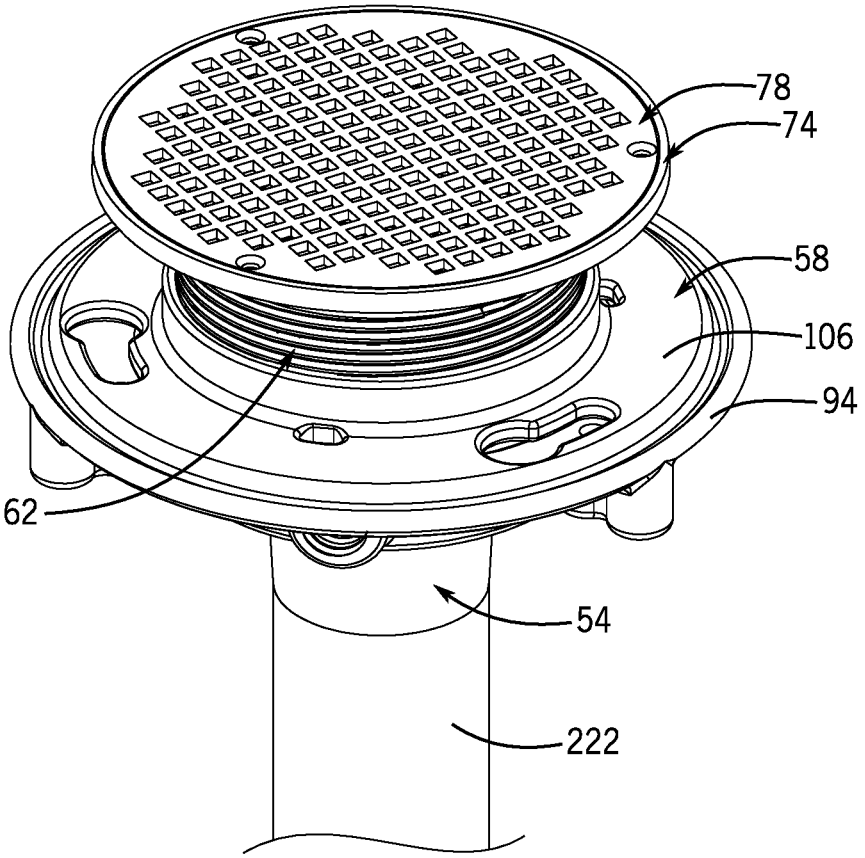
FIG. 29 is a perspective view of a first installation step of the floor drain system utilizing the sleeve assembly of FIG. 25.
Figure 30:
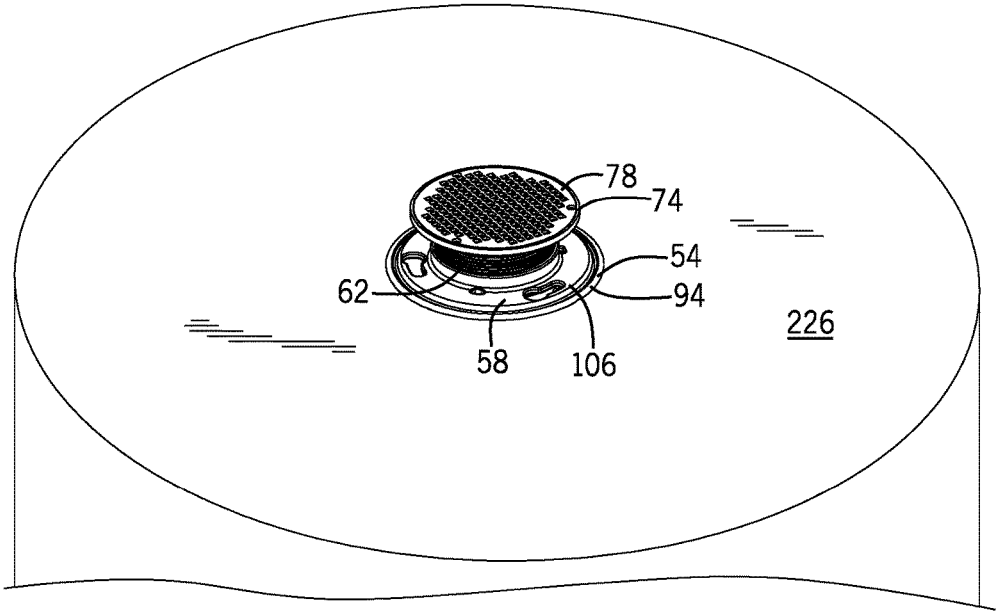
FIG. 30 is a perspective view of a second installation step of the floor drain system utilizing the sleeve assembly of FIG. 25.

As shown in FIG. 29, the shank 62, frame 74, insert 66 (hidden from view), and strainer 78 are assembled as described above. The threaded collar 58 is then threaded onto the external threaded portion 134 of the shank 62 and the drain body 54 is fastened to the threaded collar 58. The drain body 54 is first coupled to the drain pipe 222. The rough pour of concrete 226 is then completed, as shown in FIG. 30. The rough pour 226 is level with a top of the body flange 94 of the drain body 54. With the rough pour 226 completed, a waterproof membrane may be laid down over the rough pour 226 and clamped between the collar flange 106 of the threaded collar 58 and the body flange 94 of the drain body 54 (not shown).

Figure 31:
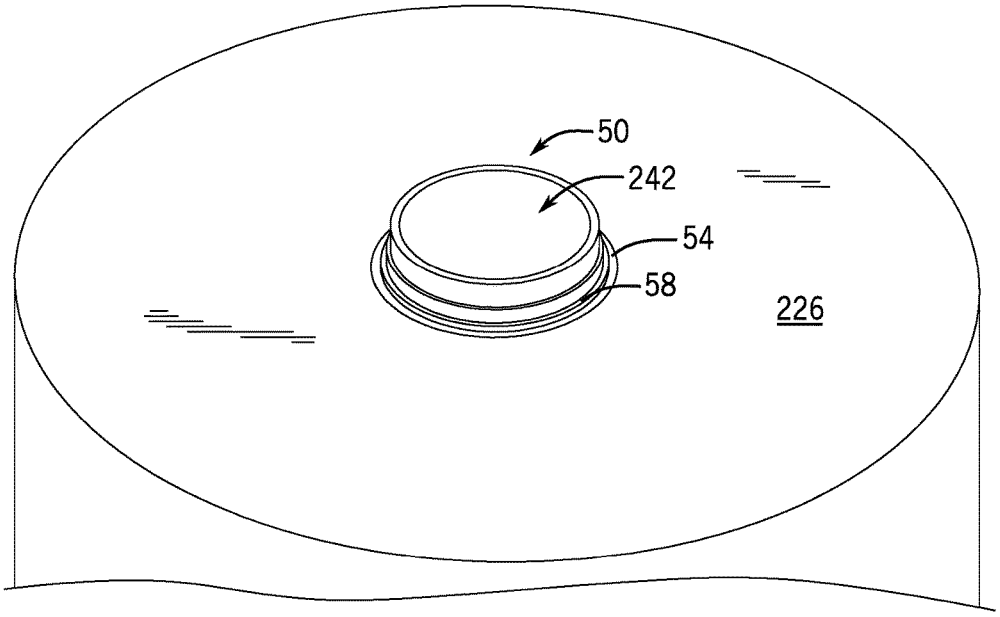
FIG. 31 is a perspective view of a third installation step of the floor drain system utilizing the sleeve assembly of FIG. 25.

With the rough pour 226 completed, the height of the strainer 78 can be adjusted to match the desired thickness of a finish pour 230. In FIG. 31, the sleeve 242 is attached by fastening the base 246 to the threaded collar 58 with fasteners through the apertures 258 in the base flange 254 and sliding the cover 250 over the upright wall 262 (see FIGS. 25, 26).

Figure 32:
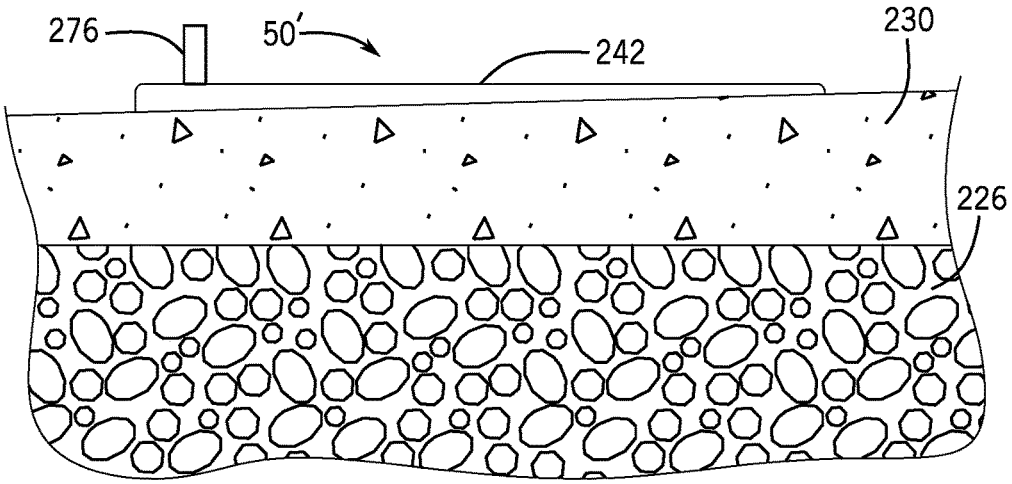
FIG. 32 is a perspective view of a fourth installation step of the floor drain system utilizing the sleeve assembly of FIG. 25.
Figure 33:
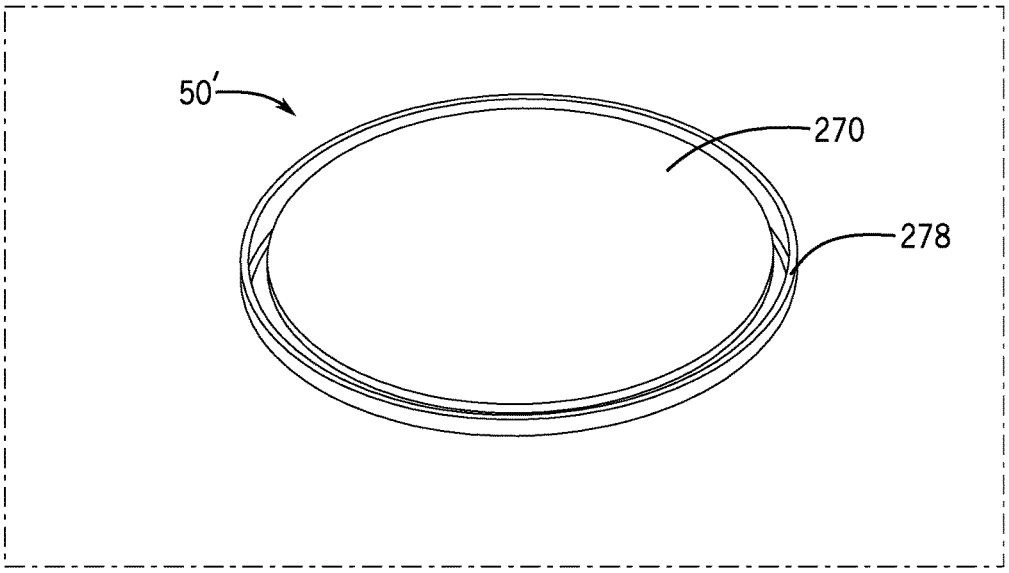
FIG. 33 is a perspective view of a fifth installation step of the floor drain system utilizing the sleeve assembly of FIG. 25.

As shown in FIG. 32, the finish pour 230 is then poured. The finish pour 230 may be angled as needed. As shown in FIG. 33, once the finish pour 230 is set, the installer grabs the pull tab 278 (for example, with a pliers) and pulls to remove the pull strip 274 from the cover 250 leaving the top disk 270 attached to the strainer 78.

Figure 34:
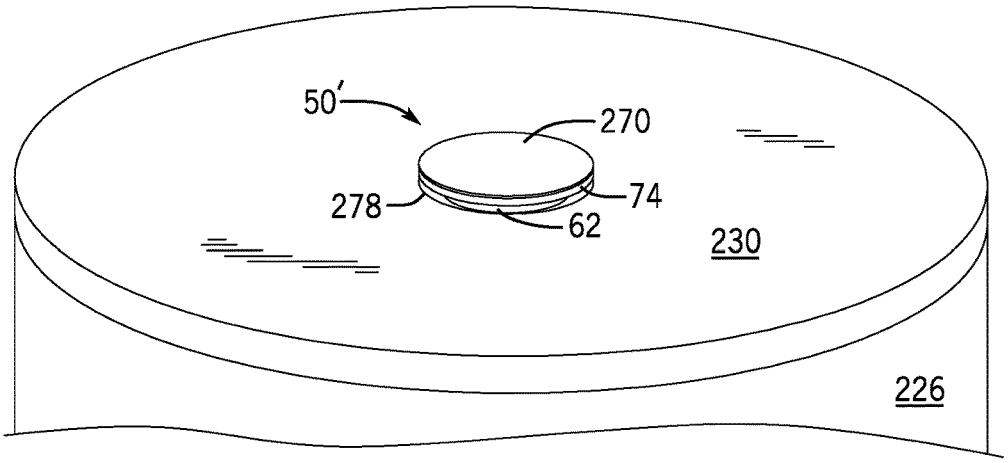
FIG. 34 is a perspective view of a sixth installation step of the floor drain system utilizing the sleeve assembly of FIG. 25.

As shown in FIG. 34, the vertical wall 278 is then cut flush with the finish pour 230 such that the installer has access to the shank 62. This cut can occur in a number of ways, such as for instance, with a razor blade or tube cutter.

Figure 35:
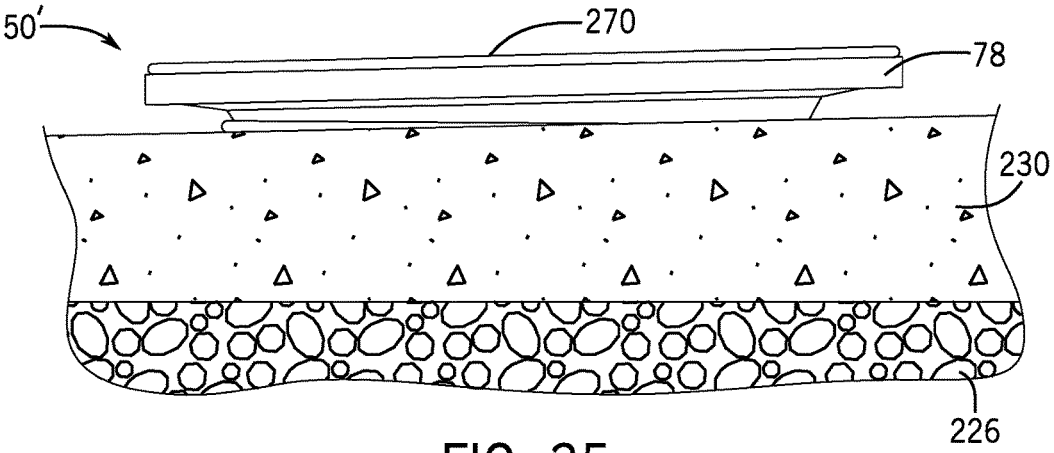
FIG. 35 is a perspective view of a seventh installation step of the floor drain system utilizing the sleeve assembly of FIG. 25.
Figure 36:
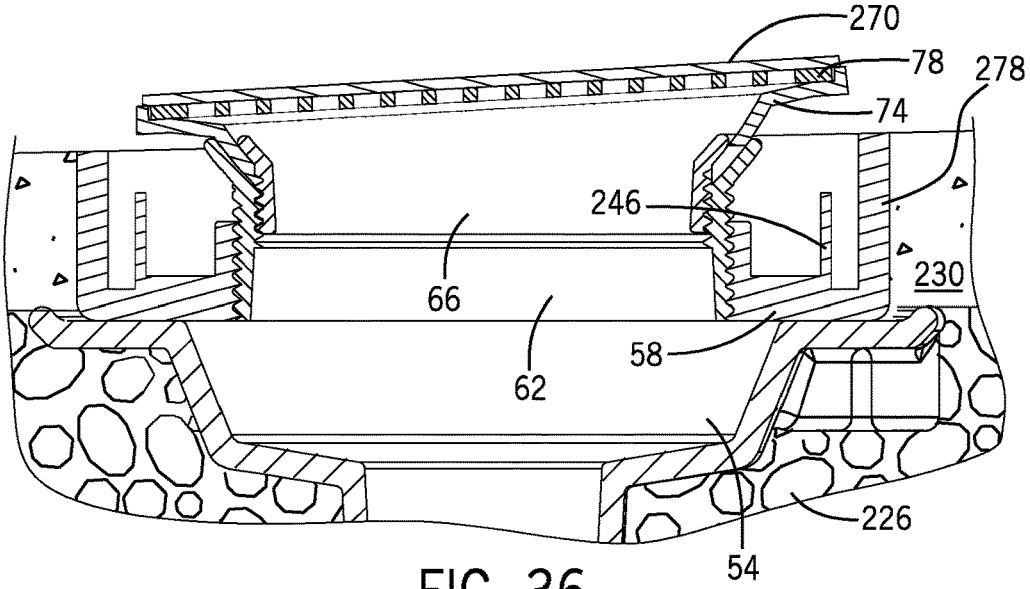
FIG. 36 is a cross-sectional view of the seventh installation step of the floor drain system utilizing the sleeve assembly of FIG. 25.

As shown in FIGS. 35 and 36, the shank 62 is then threaded out of the threaded collar 58 to raise the strainer 78 to the desired height above the finish pour 230 and tilted to match the finish grade.

Figure 37:
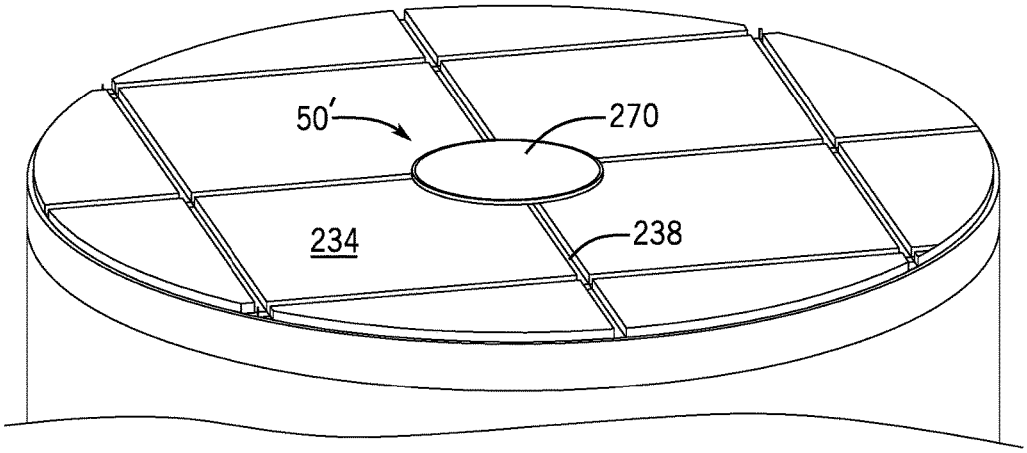
FIG. 37 is a perspective view of an eighth installation step of the floor drain system utilizing the sleeve assembly of FIG. 25.
Figure 38:
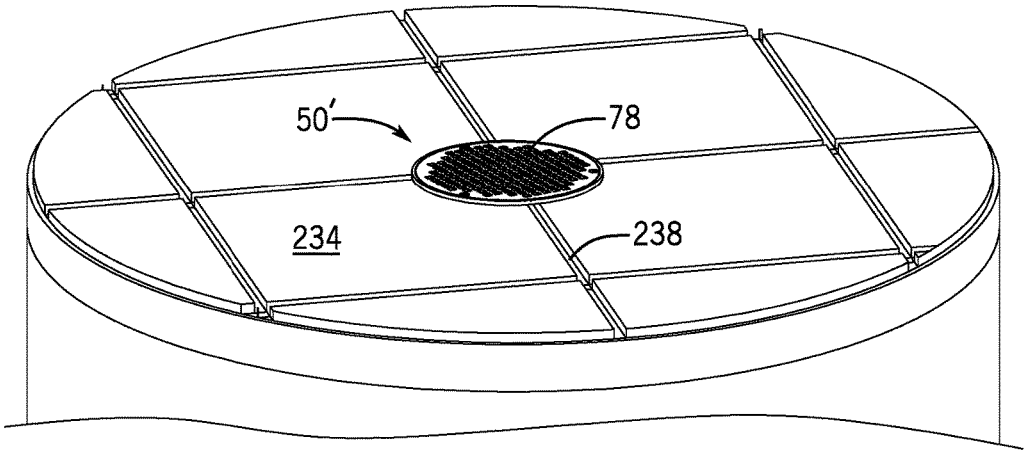
FIG. 38 is a perspective view of a ninth installation step of the floor drain system utilizing the sleeve assembly of FIG. 25.
Figure 39:
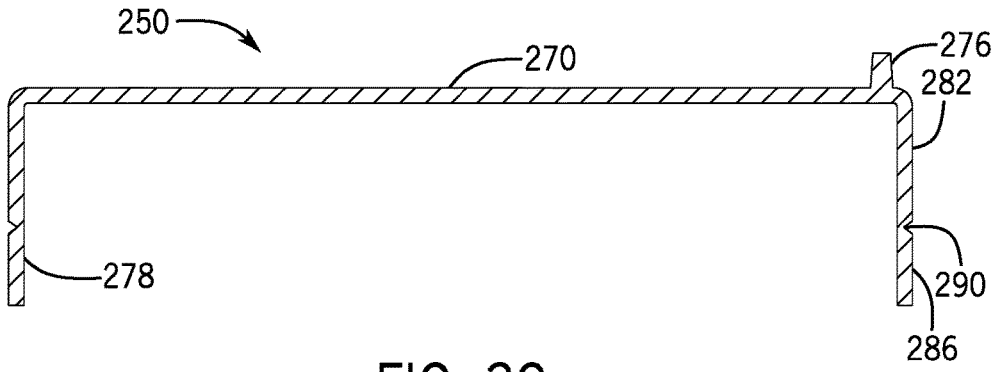
FIG. 39 is a cross-sectional view of the sleeve of FIG. 27.
Figure 40:
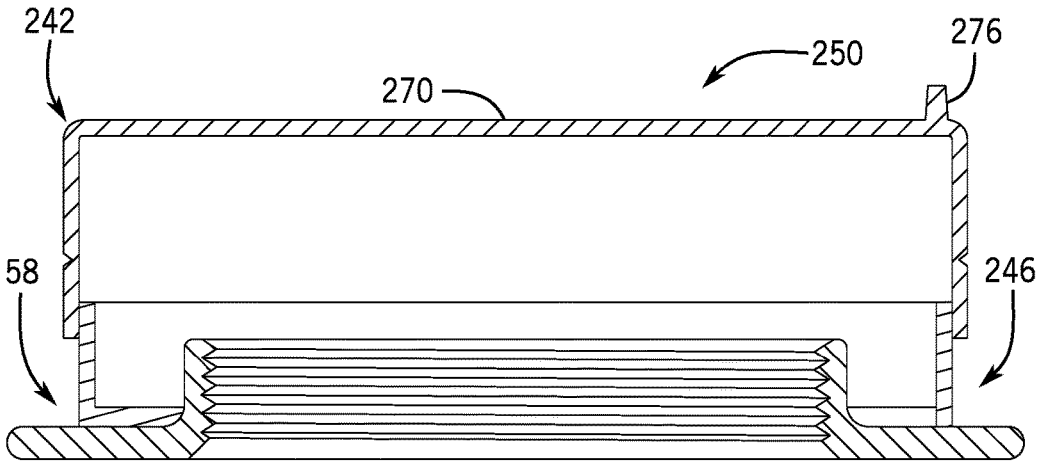
FIG. 40 is a cross-sectional view of the sleeve assembly of FIG. 25 in a first position.
Figure 41:
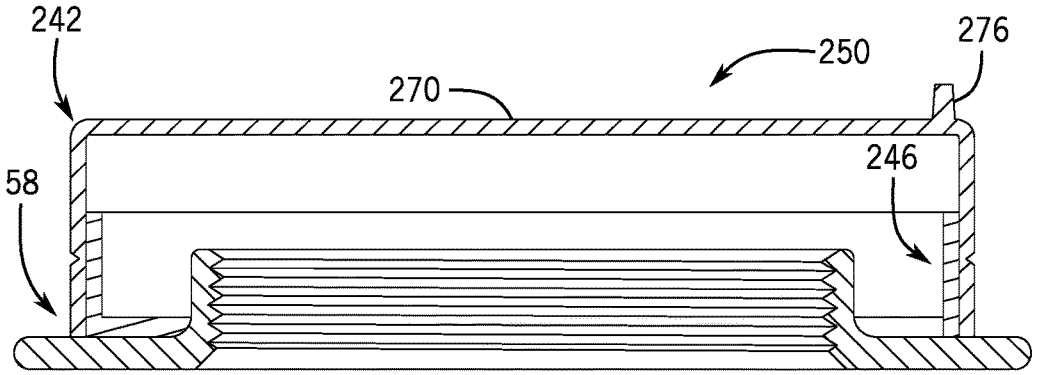
FIG. 41 is a cross-sectional view of the sleeve assembly of FIG. 25 in a second position.
Figure 42:
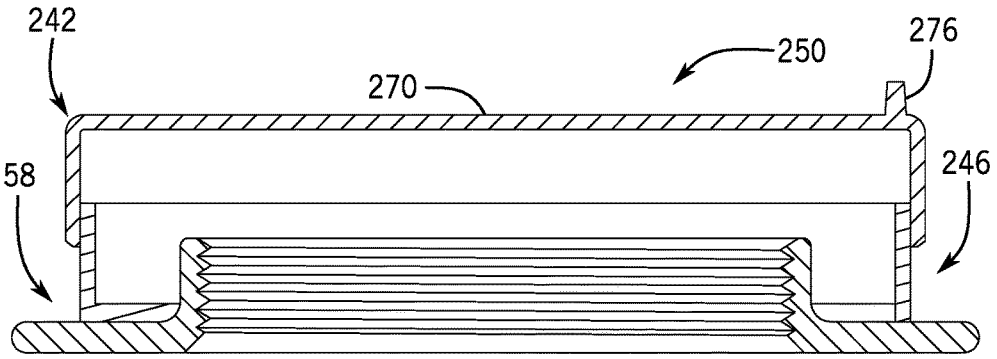
FIG. 42 is a cross-sectional view of the sleeve assembly of FIG. 25 in a third position.
Figure 43:
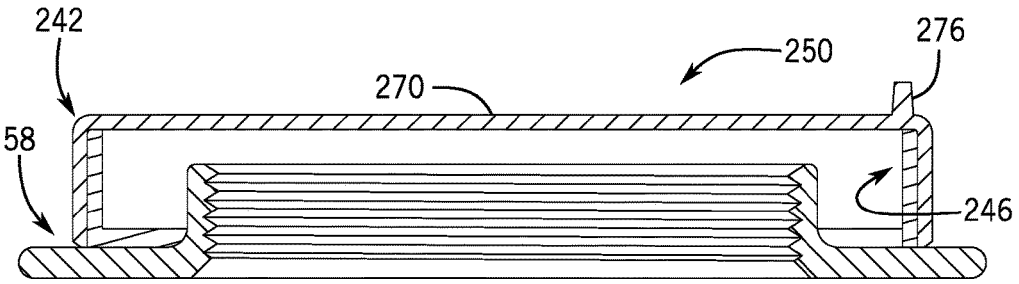
FIG. 43 is a cross-sectional view of the sleeve assembly of FIG. 25 in a fourth position.

Once the strainer 78 is at the desired height, the area within the vertical wall 278 can be backfilled with grout 238 (not shown). As shown in FIG. 37, the tile 234 is then laid around the floor drain assembly 50' and grouted. The last step is shown in FIG. 38 and involves removing the top disk 270 leaving a damage free strainer 78 and frame 74 that the end user will enjoy. The top disk protects the strainer 78 and frame 74 from the beginning of the installation until the installation is complete.

FIGS. 39-43 show the various arrangements possible with the sleeve 242. The vertical wall 278 can be cut at the parting line 290 for shallower installations, and the entire cover 242 can be adjusted up and down relative to the base 246 to provide a wide range of heights.

The rotational and tilting adjustability of the frame 74 and strainer 78 relative to the shank 62 is available before any concrete is poured, after rough concrete pour, and in some instances after the finish pour. While the above constructions where discussed with a three degree tilt possible, in other constructions more than three degrees or less than three degrees are possible.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A floor drain assembly comprising:

a collar;

a shank coupled to the collar and moveable relative to the collar, the shank including a spherically shaped shank surface;

a frame including a lower frame surface shaped to engage the shank surface and an upper frame surface;

an insert coupled to the shank and moveable relative to the shank, the insert including a spherically shaped insert surface engaged with the upper frame surface such that the frame is captured between the insert and the shank;

a strainer coupled to the frame;

a protective cover coupled to the strainer; and a sleeve surrounding the collar, the shank, the frame, the insert, the strainer, and the protective cover.

2. The floor drain assembly of claim 1, wherein the collar includes internal threads and the shank includes external threads, the internal threads of the collar engaged with the external threads of the shank.

3. The floor drain assembly of claim 1, wherein the shank moves relative to the collar along a central axis.

4. The floor drain assembly of claim 1, wherein the shank includes internal threads and the insert includes external threads, the internal threads of the shank engaged with the external threads of the insert.

5. The floor drain assembly of claim 1, wherein the insert moves relative to the shank along a central axis.

6. The floor drain assembly of claim 1, wherein the insert and the shank can be moved apart from one another to allow the frame to be tilted and rotated relative to a central axis.

7. The floor drain assembly of claim 1, wherein the insert and the shank can be moved together to inhibit the frame from moving.

8. The floor drain assembly of claim 1, wherein the spherically shaped shank surface and the spherically shaped insert surface allow the frame to be tilted in any direction by about three degrees relative to a central axis.

9. The floor drain assembly of claim 1, wherein the sleeve includes a cylindrical portion sized to engage the collar.

10. The floor drain assembly of claim 1, wherein the sleeve includes a lip sized to engage the shank.

11. The floor drain assembly of claim 1, wherein the sleeve includes a head area sized to surround the frame and strainer.

12. The floor drain assembly of claim 1, wherein the sleeve includes a removable retaining ring.

13. The floor drain assembly of claim 12, wherein the retaining ring includes a central aperture.

14. The floor drain assembly of claim 12, wherein the retaining ring engages a head area of the sleeve with tabs.

15. The floor drain assembly of claim 12, wherein the retaining ring is rotatably removable from the sleeve.

16. The floor drain assembly of claim 1, wherein the sleeve includes a pull strip.

17. The floor drain assembly of claim 16, wherein the pull strip is removable from the sleeve by a grasping and pulling action.

18. The floor drain assembly of claim 1, wherein the sleeve includes a base coupled to the collar.

19. The floor drain assembly of claim 18, wherein the sleeve further includes a cover that is slidably coupled to the base and is configured for different height installations.

20. The floor drain assembly of claim 1, wherein the protective cover is coupled to the sleeve with a pull strip.

21. The floor drain assembly of claim 20, wherein the pull strip is removable from the sleeve and the protective cover, and when removed detaches the protective cover from the sleeve.

22. The floor drain assembly of claim 1, wherein the protective cover is an adhesive backed sticker.

23. The floor drain assembly of claim 1, wherein the shank and the insert provide height and tilt adjustment of the frame and strainer before and during installation.

24. A method for installing a floor drain assembly, the method comprising:

coupling a floor drain assembly with a drain body, the floor drain assembly comprising a collar, a shank coupled to the collar and moveable relative to the collar, the shank including a spherically shaped shank surface, a frame including a lower frame surface shaped to engage the shank surface and an upper frame surface, an insert coupled to the shank and moveable relative to the shank, the insert including a spherically shaped insert surface engaged with the upper frame surface such that the frame is captured between the insert and the shank, a strainer coupled to the frame, a protective cover coupled to the strainer, and a sleeve surrounding the collar, the shank, the frame, the insert, the strainer, and the protective cover;

coupling the drain body with a drain pipe;

making a rough pour of concrete around a portion of the drain assembly;

adjusting a height of the strainer;

making a finish pour;

removing a portion of a retaining ring coupled to the sleeve; and removing the protective cover from the strainer.

* * * * *